US006688130B1

(12) United States Patent
Kim

(10) Patent No.: US 6,688,130 B1
(45) Date of Patent: Feb. 10, 2004

(54) ICE MAKING MACHINE

(75) Inventor: Oh-bok Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 10/420,479

(22) Filed: Apr. 22, 2003

(30) Foreign Application Priority Data

Oct. 31, 2002 (KR) ..... 2002-66736

(51) Int. Cl.[7] ..... E25C 1/18
(52) U.S. Cl. ..... 62/352; 62/68
(58) Field of Search ..... 62/68, 352, 353

(56) References Cited

U.S. PATENT DOCUMENTS 3,791,166 A * 2/1974 Maleck ..... 62/138
4,184,339 A * 1/1980 Wessa ..... 62/68
4,572,785 A * 2/1986 Braaten ..... 210/181
4,685,304 A * 8/1987 Essig ..... 62/68
5,127,236 A * 7/1992 von Blanquet ..... 62/135
5,187,948 A * 2/1993 Frohbieter ..... 62/351

* cited by examiner

*Primary Examiner*—William E. Tapolcai
(74) *Attorney, Agent, or Firm*—Ladas & Parry

(57) ABSTRACT

An ice making machine comprises a housing, an evaporator connected to a freezing system, a base frame having a plurality of freezing cells for being filled with water to be frozen, a freezing base plate provided with the evaporator and freezing fingers formed on the lower surface of the freezing base plate to be dipped into the water supplied to the freezing cells, and an air removing means for pumping the water into the freezing cells to remove air bubbles inside the water, thereby forming clear pieces of ice. The air removing means comprises a water path disposed at the base frame to be connected to the freezing cells, a water pocket connected to the water path and being replenished with water form an external water supply, and a pressing means for repeatedly pressing the water pocket to pump the water of the water pocket into each freezing cell.

7 Claims, 5 Drawing Sheets

ICE MAKING MACHINE

BACKGROUND OF THE INVENTION

1. Field of the Invention

The present invention relates generally to an ice-making machine, and more particularly, to an ice-making machine reducing ice making time and preventing wastage or loss of water to be frozen.

2. Description of the Prior Art

An ice-making machine is used for freezing water to thus form ice pieces. There has already been proposed an ice-making machine capable of preventing opacification, which occurs as air bubbles inside the water are frozen.

FIGS. 1 and 2 show a conventional ice-making machine, which was disclosed in the U.S. Pat. No. 5,425,243.

As shown in FIGS. 1 and 2, the conventional ice-making machine includes a housing 10, a freezing unit 20, and an air-removing means 40.

The housing 10 has an ice bin 11 for storing ice pieces formed in the freezing unit 20. Under the ice bin 11 are disposed a compressor 12 and a condenser 13.

As shown in FIG. 2, the freezing unit 20 includes a water tray 21, a freezing base plate 23, and an evaporator 30. The water tray 21 is filled with water to be frozen. A plurality of freezing fingers 22 are disposed on the lower surface of the freezing base plate 23 to be dipped in the water. One side of the water tray 21 is provided with a pivoting means for tilting the water tray 21 to allow unfrozen water to be discharged. The evaporator 30 is disposed on the upper surface of the freezing base plate 23 and is connected to a freezing system. As the refrigerant flows inside the evaporator 30, the freezing base plate 23 and the freezing fingers 22 are cooled by the heat exchange of the refrigerant within the evaporator 30.

The air-removing means 40 is for removing air bubbles inside the water to prevent opacification occurring during ice formation. The air-removing means 40 includes a rocking plate 41 rocking upward and downward inside the water tray 21 and a rocking motor 42 for driving the rocking plate 41. An engagement piece 43 disposed at the rocking motor 42 upwardly pushes an engagement pin 44 of the rocking plate 41 to move the rocking plate 41. The rocking movement of the rocking plate 41 causes the air bubbles to float upwardly and outside the water to be frozen, thereby removing the air bubbles.

The freezing unit 20 further includes a water supply pipe 14, a pivotal shaft 25, a water chute 26, and a water collecting section 15.

Hereinafter, the operation of the conventional ice-making machine is described.

The water to be frozen is supplied to the water tray 21 through the water supply pipe 14 and then the freezing fingers 22 are dipped into the water, the water starts to freeze around the freezing fingers 22 that are cooled to a temperature of 0° C. or lower by the heat exchange of the refrigerant flowing inside the evaporator 30. At the same time, the rocking motor 42 is activated to vertically rock the rocking plate 41 that is immersed in the water. Accordingly, the water is rocked and thus the air bubbles inside the water are removed. As a result, clear ice pieces are formed around the freezing fingers 22.

The ice pieces are gradually formed around the freezing fingers 22 to a predetermined size, and when the process is completed, the rocking plate 41 stops being rocked. Hot gas is discharged from the compressor 12 without passing through the condenser 13 and is directly supplied into the evaporator 30 to temporarily heat the freezing fingers 22, and then the water tray 21 pivots on the pivotal shaft 25 by the pivoting means 24 to thus be tilted. Accordingly, the formed ice pieces are separated from the freezing fingers 22 and then are dropped into the ice bin 11, and the unfrozen water that remains in the water tray 21 is guided along the water chute 26 and discharged into the water collecting section 15 (FIG. 1).

Such conventional ice making machines require an amount of water exceeding what is actually to be frozen as the water tray is designed to hold more than the amount of water necessary to make ice pieces, thereby wasting a lot of water to excess runoff.

Moreover, since the freezing fingers 22 cool not only the water around the freezing fingers 22 but also all of the water in the water tray 21, too much energy is consumed and the generation rate of the ice pieces formed around the freezing fingers 22 is slow.

SUMMARY OF THE INVENTION

The present invention has been developed in order to solve the above-described problems in the prior art. Accordingly, an object of the present invention is to provide an ice-making machine making unnecessary the freezing of waste water by supplying a predetermined amount of water into a plurality of freezing chambers having predetermined sizes, and reducing the time required to form ice pieces by increasing the freezing speed around freezing fingers.

The above objects are achieved by providing an ice making machine comprising a housing, an evaporator connected to a freezing system, a base frame having a plurality of freezing cells for being filled with water to be frozen, a freezing base plate provided with the evaporator and freezing fingers formed on the lower surface of the freezing base plate to be dipped into the water supplied to the freezing cells, and an air removing means for pumping the water into the freezing cells so as to remove air bubbles inside the water, thereby forming clear ice pieces.

It is preferred that the air removing means comprises a water path disposed within the base frame to be connected to the freezing cells, a water pocket connected to the water path and replenished with water, and a pressing means for repeatedly pressing the water pocket to pump the water of the water pocket into each freezing cell.

Preferably, the pressing means comprises a cam disposed in contact with the water pocket and a cam motor for rotating the cam.

Also, it is preferred that at a side of the water pocket is disposed a valve in the water path for forcedly injecting the water into the freezing cells.

Also, it is preferred that the water pocket is made of a soft impermeable material, such as a silicone.

Also, it is preferred that between the cam and the water pocket is interposed a pressing plate.

BRIEF DESCRIPTION OF THE DRAWINGS

The above object and the feature of the present invention will be more apparent by describing a preferred embodiment of the present invention in greater detail with reference to the accompanying drawings, in which.

DESCRIPTION OF THE PREFERRED EMBODIMENT

Figure 1:
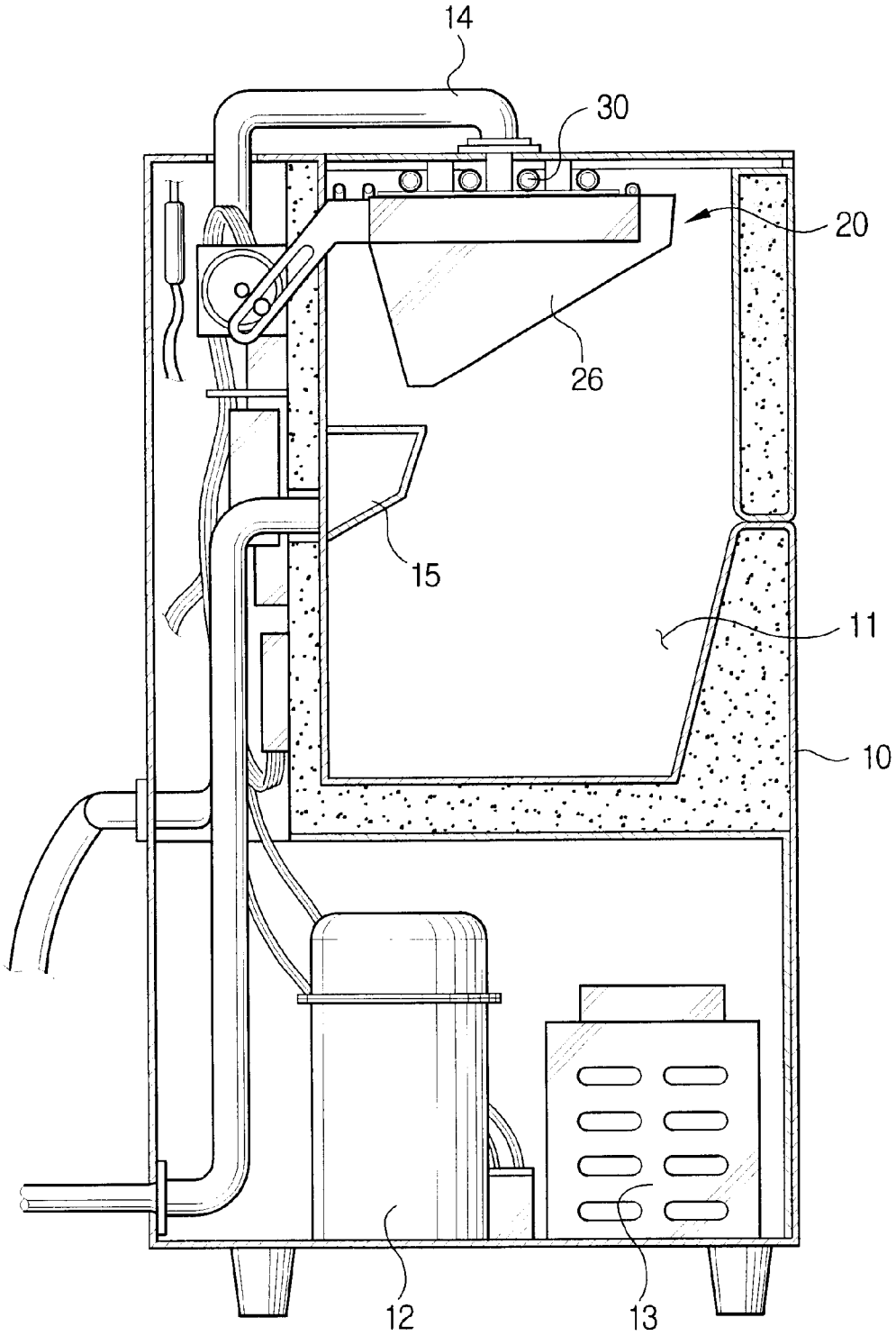
FIG. 1 (PRIOR ART)
FIG. 1 is a cross-sectional view showing a conventional ice-making machine.
Figure 2:
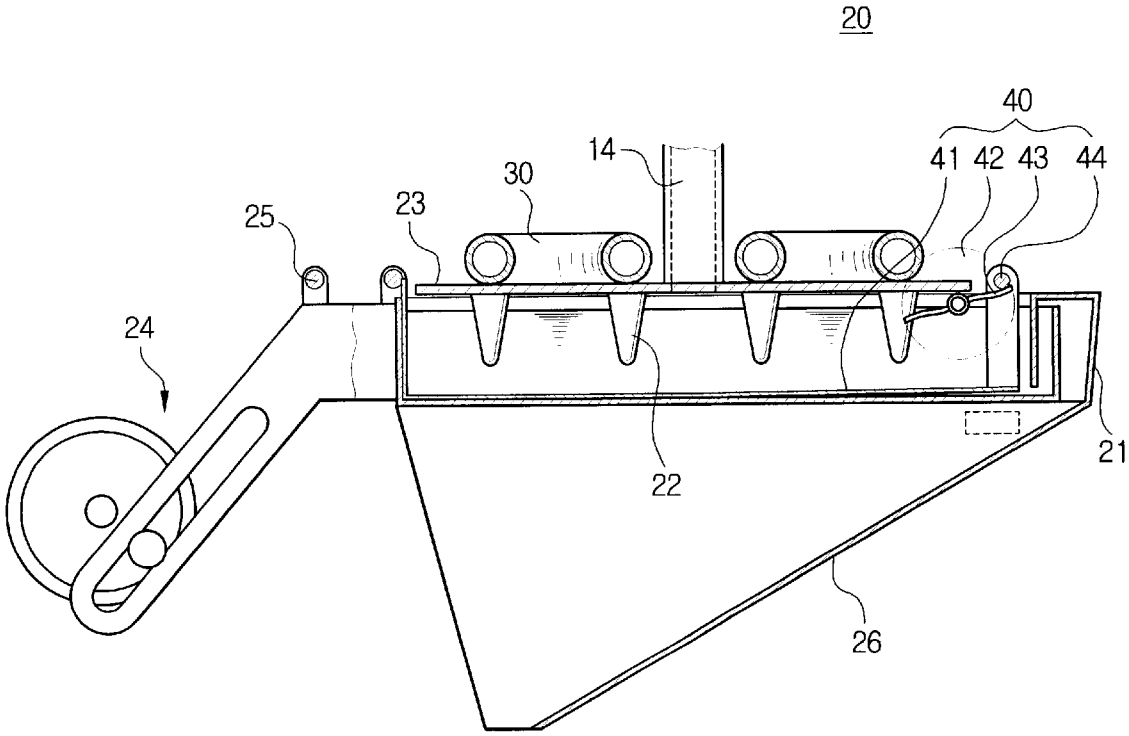
FIG.2 (PRIOR ART)
FIG. 2 is a side partial cross-sectional view showing a part of the machine shown in FIG. 1.

Hereinbelow, an ice-making machine according to a preferred embodiment of the present invention is described with reference to the accompanying drawings. With respect to the elements identical to those shown in the prior art, like reference numerals will be assigned to indicate like elements.

Figure 3:
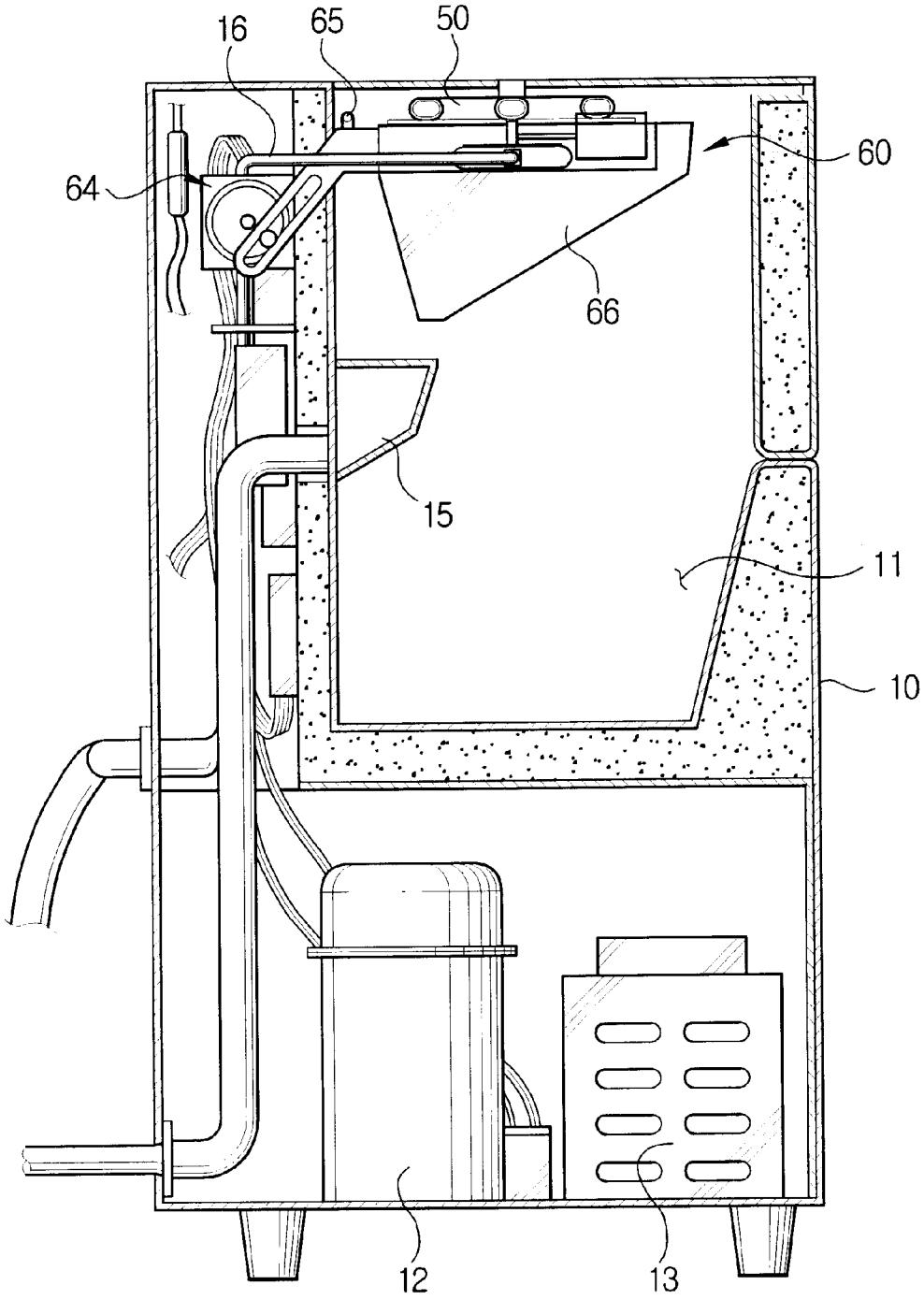
FIG. 3 is a cross-sectional view showing an ice-making machine according to a preferred embodiment of the present invention.
Figure 4:
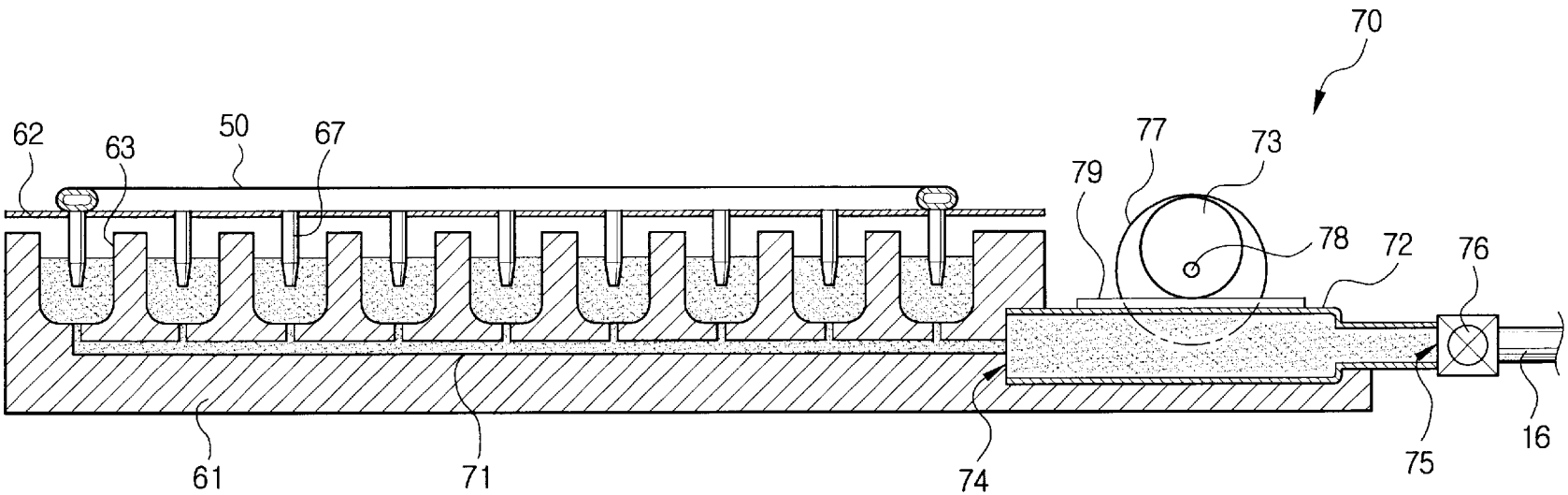
FIG. 4 is a cross-section view showing a part of the machine shown in FIG. 3.

As shown in FIGS. 3 and 4, an ice-making machine according to the present invention includes a housing 10, a freezing unit 60, and an air-removing means 70.

The housing 10 has an ice bin 11 for storing therein ice pieces formed in the freezing unit 60. Under the ice bin 11 are disposed a compressor 12 and a condenser 13 constituting a refrigeration or freezing system. At one side of the ice bin 11 is provided a water collecting section 15 for collecting unfrozen water.

The freezing unit 60 includes a base frame 61, a freezing base plate 62, and an evaporator 50. The base frame 61 is pivotably disposed on the housing 10 and has a plurality of freezing cells 63 for being filled with water to be frozen. When the base frame 61 pivots on a pivotal shaft 65 to a predetermined angle by a pivoting means 64, the unfrozen ice water in the freezing cells 63 is guided along the water chute 66 and discharged out. The freezing cells 63 are formed having predetermined sizes, which take into consideration the sizes of the ice pieces and the water freezing speed, and the number of the freezing cells may range from 20 to 30, and preferably, number 27.

The freezing base plate 62 is provided with the evaporator 50 disposed on the upper surface thereof and freezing fingers 67 formed on the lower surface thereof shaped and dimensioned to be dipped into the water supplied to each of the freezing cells 63. The evaporator 50 is connected to the freezing system so that refrigerant is allowed to flow inside the evaporator 50. The freezing fingers 67 are cooled at a temperature of 0° C. or lower by heat exchange of the refrigerant flowing inside the evaporator 50 and thus the ice pieces are gradually frozen around the freezing fingers 67.

The air-removing means 70 includes a water path 71 provided within the base frame 61 to be connected to each of the freezing cells 63, a water pocket 72 in fluid communication with the water path 71, and a cam 73 for pressing the water pocket 72 repeatedly.

The water pocket 72 has an outlet portion 74 in fluid communication with the water path 71 and an inlet portion 75 at which a valve 76 is disposed. The valve 76 is used for regulating water supply from an external water supply through pipe 16 to the water pocket 72 by opening and closing the inlet portion 75. The water pocket 72 is made of soft material such as silicone and thus can be deformed by an external pressure. Accordingly, the water pocket 72 shrinks under the external pressure of the cam 73 to thus inject a predetermined amount of the water to be frozen into the water path 71 and increase the water level of the water in the freezing cells 63. When the external pressure is removed, the water pocket 72 expands to its original shape so that the water is returned to the water pocket 72. Accordingly, the water level decreases to the original level.

The cam 73 for pressing the water pocket 72 periodically is rotatably disposed at a cam shaft 78 connected to a cam motor 77. Between the cam 73 and the water pocket 72 is disposed a pressing plate 79. The pressing plate 79 is for preventing damage that occurs due friction between the cam 73 and the water pocket 72 and for increasing the area of the water pocket 72 pressed by the cam 73.

Figure 5:
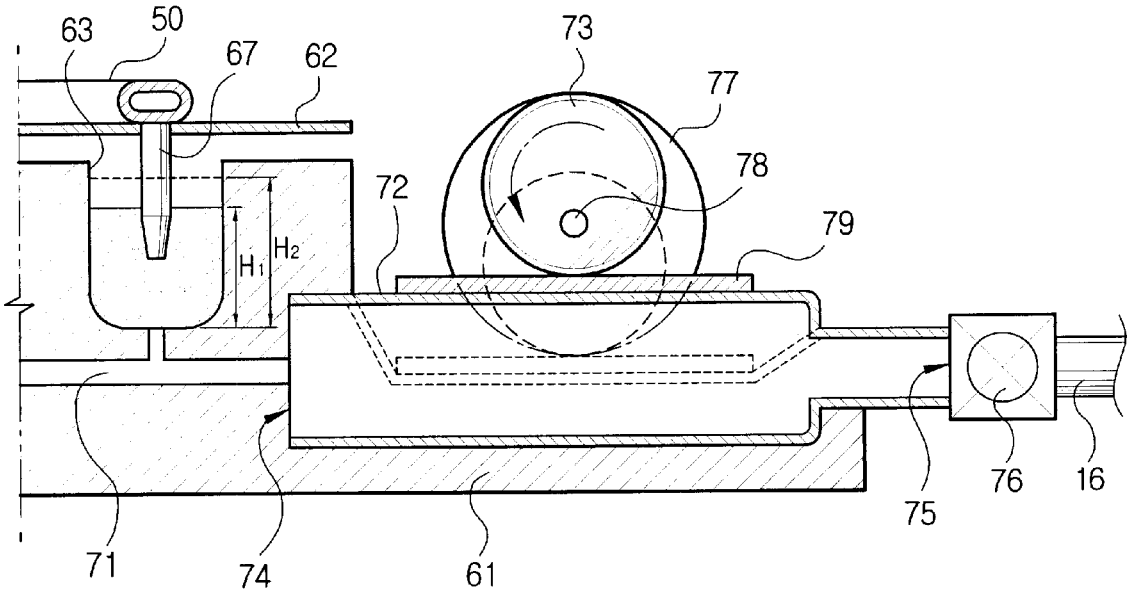
FIG. 5 is a partial cross-sectional view illustrating the operation of the freezing unit of the ice-making machine shown in FIG. 3.

Hereinbelow, the operation of the ice-making machine according to the present invention is described, referring to FIGS. 3, 4 and 5.

When the valve 76 disposed between the water pocket 72 and the water supply pipe 16 is opened, the water is forcedly injected into the water pocket 72 by the water pressure in the pipe 16. The water of the water pocket 72 flows into the water path 71 via the outlet portion 74 and then to the water cells 63. When the water in the freezing cells 63 reaches a predetermined water level $H_1$, the valve 76 is closed to block further inflow of the water. At this time, the water pocket 72 expands with the water filled therein.

After the water has been supplied and as the cam motor 77 is activated, the cam 73 rotates in contact with the pressing plate 79 to press the water pocket 72 periodically. Accordingly, the water pocket 72 repeats shrinking and swelling to thus pump the water into the freezing cells 63, as shown by the dotted lines. Also, the water in the freezing cells 63 rocks upward and downward so that the water level goes up and down between the levels $H_1$ and $H_2$ with the repeated operation of the cam 73.

Due to the rocking movement of the water in the freezing cells 63, air bubbles on the surfaces of the freezing fingers 67 float upwardly and out of the water. Accordingly, around the freezing fingers that are cooled at about −22° C. removal of the air bubbles from the water permits the water to be frozen to form clear ice pieces.

When the ice pieces are gradually formed around the freezing fingers 67 to predetermined sizes, the cam 73 stops being rotated and the base frame 61 pivots on the pivotal shaft 65 by action of the pivoting means 64. When the base frame 61 is tilted toward a side, unfrozen water in the freezing cells 63 is guided along the water chute 66 and discharged to the water collecting section 15. Hot gas from the compressor 12 is bypassed to the evaporator 50 without passing through the condenser 13. Accordingly, as the freezing fingers 67 are heated to about 10° C., the ice pieces are separated from the freezing fingers 67 and are dropped into the ice bin 11.

According to the present invention as de scribed above, a predetermined amount of the water to be frozen is supplied to each of the plurality of freezing cells 63 having a predetermined size. Accordingly, as the amount of the water to be supplied can be reduced, it provides an effect that waste of the water is prevented.

Moreover, according to the present invention, since the freezing fingers 67 cooled to the temperature of 0° C. or lower are dipped into the predetermined amount of the water supplied to the respective freezing cells 63, water freezing speed around the freezing fingers 67 is increased and thus the time required to form ice pieces is reduced.

The foregoing embodiment and advantages are merely exemplary and are not to be construed as limiting the present invention. The present teaching can be readily applied to other types of apparatus. The description of the present invention is intended to be illustrative, and not to limit the scope of the following claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An ice making machine comprising:

a housing;

an evaporator connected to a freezing system;

a base frame having a plurality of freezing cells for being filled with water to be frozen;

a freezing base plate provided with the evaporator and freezing fingers formed on the lower surface of the freezing base plate to be dipped into the water supplied to the freezing cells; and an air removing means for pumping the water into the freezing cells to remove air bubbles inside the water, thereby forming clear ice pieces.

2. The ice making machine of claim 1, wherein the air removing means comprises:

a water path disposed in the base frame to be connected to the freezing cells;

a water pocket connected to the water path and being replenished with the water from an external water supply; and a pressing means for repeatedly pressing the water pocket to thereby pump the water in the water pocket into each freezing cell.

3. The ice making machine of claim 1, wherein the pressing means comprises:

a cam disposed in contact with the water pocket; and a cam motor for rotating the cam.

4. The ice making machine of claim 2, wherein at a side of the water pocket is disposed a valve in line with the water path for forcedly injecting the water into the freezing cells.

5. The ice making machine of claim 2, wherein the water pocket is made of a soft impermeable material.

6. The ice making machine of claim 2, wherein the water pocket is made of silicone.

7. The ice making machine of claim 3, wherein between the cam and the water pocket is interposed a pressing plate.

* * * * *